United States Patent [19]

Skagerlund

[11] Patent Number: 4,936,216

[45] Date of Patent: Jun. 26, 1990

[54] DETECTOR DEVICE

[75] Inventor: Lars-Erik Skagerlund, Karlskoga, Sweden

[73] Assignee: Aktiebolaget Bofors, Bofors, Sweden

[21] Appl. No.: 247,334

[22] Filed: Sep. 21, 1988

[30] Foreign Application Priority Data

Sep. 21, 1987 [SE] Sweden ..... 8703630

[51] Int. Cl.[5] ..... F42C 13/02

[52] U.S. Cl. ..... 102/213; 356/4

[58] Field of Search ..... 102/211, 213; 356/4

[56] References Cited

U.S. PATENT DOCUMENTS

| | | | |
|---|---|---|---|
| 3,034,436 | 5/1962 | Arthaber et al. . | |
| 3,942,446 | 3/1976 | Cruzan . | |
| 4,010,689 | 3/1977 | Sochard et al. . | |
| 4,022,132 | 5/1977 | Blomqvist et al. . | |
| 4,213,394 | 7/1980 | Brenner | 102/213 |
| 4,310,760 | 1/1982 | Gardner . | |
| 4,409,900 | 10/1983 | Currie | 102/213 |
| 4,627,351 | 12/1986 | Thordarson et al. | 102/213 |
| 4,651,647 | 2/1988 | Baker | 102/213 |

FOREIGN PATENT DOCUMENTS

| | | | |
|---|---|---|---|
| 2631212 | 4/1976 | Fed. Rep. of Germany . | |
| 1199438 | 12/1959 | France | 102/213 |
| 2504684 | 7/1979 | France . | |
| 143005 | of 0000 | Norway . | |
| 772531 | 4/1957 | United Kingdom | 102/213 |
| 2105016 | 3/1983 | United Kingdom | 102/213 |

*Primary Examiner*—Charles T. Jordan
*Assistant Examiner*—Stephen Johnson
*Attorney, Agent, or Firm*—Pollock, Vande Sande & Priddy

[57] ABSTRACT

Transmitter and receiver devices are included in an active optic proximity fuse for providing increased resistance to aerosols. The transmitter and receiver units operate with optical radiation and include a signal processing unit which reacts to a target located in a sensing region and reflecting optical radiation emitted from the transmitter device to the receiver device. The sensing region displays, most proximal a carrier of the proximity fuse, an inner sensing limit which is located at an inner distance from the carrier. The signal processing unit operates with preparatory signal processing and/or time measurement of reflected signals when the target is located within the sensing region, and emits an activation signal only when the target passes the inner sensing limit.

4 Claims, 3 Drawing Sheets

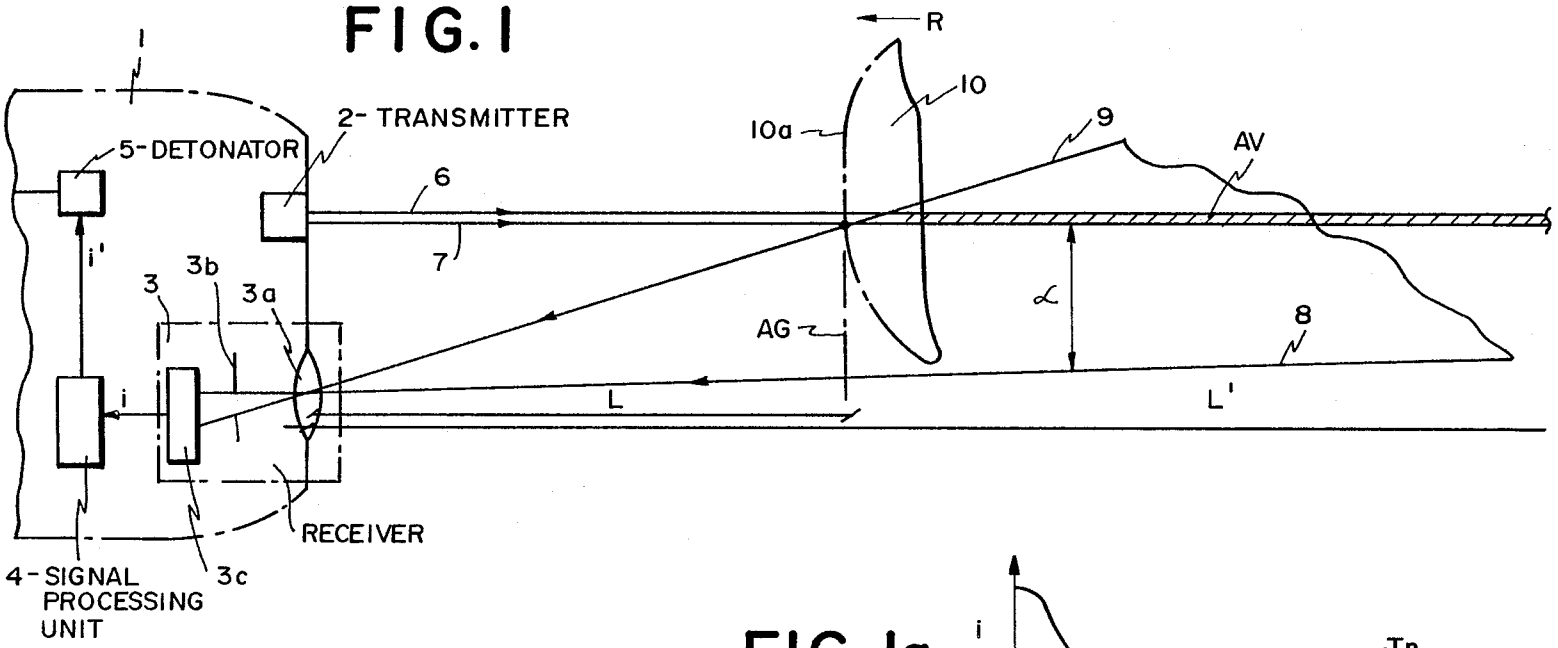
FIG. 1
2- TRANSMITTER
5- DETONATOR
RECEIVER
4- SIGNAL PROCESSING UNIT
R
AV
AG
L
L'
α
1
3
3a
3b
3c
6
7
8
9
10
10a
i
i'
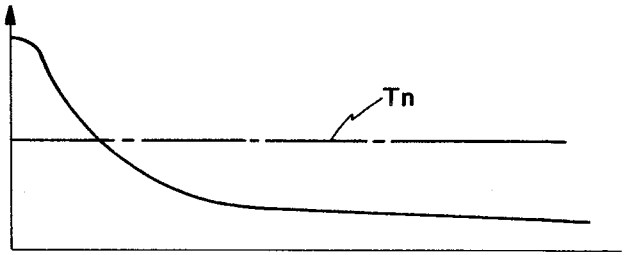
FIG. 1a
Tn
i
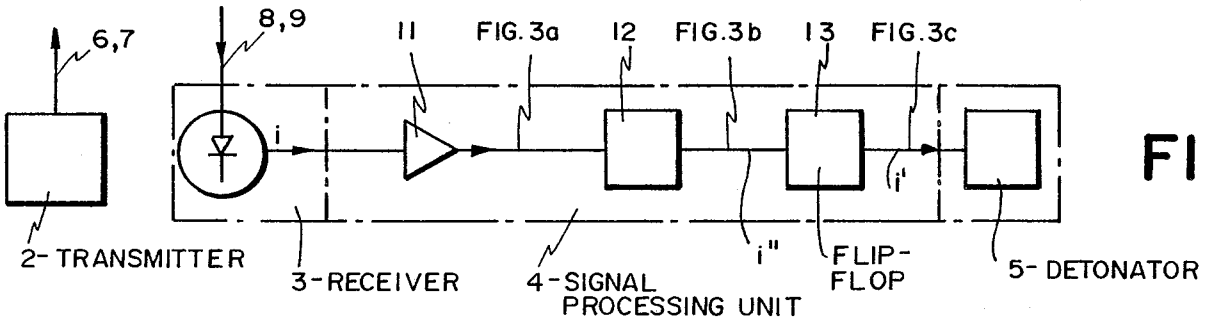
FIG. 2
2- TRANSMITTER
3- RECEIVER
4- SIGNAL PROCESSING UNIT
5- DETONATOR
FLIP-FLOP
FIG.3a
FIG.3b
FIG.3c
6,7
8,9
11
12
13
i
i'
i'' t
t'
t''
t'''
bak'
$i_s$
$i$
$i_T$
$i_v$
$i_g$
$i_{vl}$
2'

DETECTOR DEVICE

BACKGROUND OF THE INVENTION

Technical Field

The present invention relates to a device for providing, in an active optic proximity fuse, an increased resistance to precipitation, smoke, clouds, etc. The present invention is applicable to proximity fuses of the type which includes transmitter and receiver units for optical radiation, and a signal processing unit which is intended to react to a target which is located in the scanning and sensing region of the proximity fuse and reflects optical radiation emitted from the transmitter back to the receiver device. When a predetermined distance between the target and the proximity fuse, the triggering distance, has been attained, the proximity fuse emits a triggering signal to a warhead in the carrier of the proximity fuse.

Background Art

The present invention is primarily applicable to proximity fuses with forwardly-aimed sensitivity lobes which may operate according to different principles. In a first embodiment, use may be made of intersecting emission and reception lobes, the sensing region for a target being located within that area where the lobes overlap. In a second embodiment, densely occurring brief pulses are emitted, the transit time for each respective emitted and reflected, received pulse being established. In this case, the sensing region is defined by the selection of a maximum permissible transit time interval between the emitted and reflected pulses.

It is well known in the employment of optic proximity fuses that aerosols cause disturbance in detection by reflecting, within the sensitivity range, the emitted optical radiation back towards the receiver unit. The major part of this "jamming" signal derives from that part of the sensing region which is located most proximal the inner limit of the region.

In prior-art proximity fuses, use has been made, for example, of measurement base and intersecting lobes, with the outer intersection limit at the triggering distance of the proximity fuse and the inner intersection limit close to the proximity fuse proper. Thus, triggering of the proximity fuse has taken place on entry into the sensing region which has been well defined, at least to its outermost limit.

In prior-art constructions, the receiver of the proximity fuse must be dimensioned with sufficient sensitivity to be able to detect targets at the outermost limit of the sensitivity region. Since the major part of the signal reflected by aerosols derives from the inner area of the sensitivity region and, hence, has shorter distance to travel, but a relatively slight degree of aerosol reflection is required for the function of the proximity fuse to be deranged.

SUMMARY OF THE INVENTION

The novel proximity fuse according to the present invention operates according to a principle different from that employed in the prior art. The well-defined inner limit of the sensing region is retained, while the outer sensing limit may, in one embodiment, be selected to be more diffuse and in certain cases, be dispensed with entirely.

The main object of the present invention is to increase resistance to aerosols while retaining a relatively simple construction of the proximity fuse.

A first novel feature of the present invention is that the sensitivity region of the proximity fuse is directed dead head or obliquely ahead such that, when the carrier of the proximity fuse approaches the target, a return signal can be obtained from the target while the distance to the target is still greater than the triggering distance. A second feature is that the inner limit of the sensitivity region is rendered well-defined and placed at the triggering distance of the proximity fuse. A third feature is that the sensing function includes a preprocessing stage for the received signal where, in principle, it is established when the reflected, received signal exceeds a predetermined threshold level. The sensing function also includes a triggering or activation phase which occurs when the target passes the inner limit, such as when the received, reflected signal ceases.

In the establishment of the sensing region by means of measurement of the transit time between emitted and received, reflected pulse, the triggering distance is determined by a shortest permitted transit time.

In a further embodiment of the present invention, the signal processing unit is to include one or more flip-flop devices which are actuable on passage by the target of the inner limit and then occasion the emission of a warhead detonation signal. The signal processing unit may also include a threshold device which emits an output signal to the flip-flop device or devices when the received, reflected signal exceeds a predetermined threshold.

In that case when the transmitter and receiver devices operate with at least theoretically intersecting lobes, the outer intersection limit may be selected in close proximity to infinity, such that the one defining line of the receiver lobe extends almost parallel with the center line of the transmitter lobe.

In an alternative embodiment, the transmitter and receiver devices may also operate with densely occurring brief pulses, in which event the signal processing unit preferably includes some type of comparator circuit which senses the emitted and received, reflected pulses above the level of the threshold device and, at a transit time between these which lies within a predetermined transit time interval defining the inner and outer sensing limits in the sensing region, generates a signal which may be impressed upon the flip-flop device or devices employed.

In the case of transit time sensing, the flip-flop may include a first resettable monostable flip-flop which receives the signal from the comparator circuits, and a second, rear-edge triggered flip-flop connected to the first flip-flop.

As a result of the above-outlined improvements, there will be obtained a considerable increase in resistance to the effects of cloud, smoke and precipitation, since the sensing region of the proximity fuse is located outside the triggering region. This results in a relatively long travel distance for the total disturbing reflection and, thereby, considerable damping thereof.

BRIEF DESCRIPTION OF THE ACCOMPANYING DRAWINGS

The present invention will be described in greater detail below with reference to the accompanying drawings.

In the accompanying drawings:

FIG. 1 schematically illustrates transmitter and receiver devices operating with intersecting lobes with inner and outer sensing limits;

FIG. 1*a* shows, in diagram form, the amplitude gain in the reflected, received signal as a function of the distance within the sensing region;

FIG. 2 is a block diagram showing transmitter and receiver units and a signal processing unit connected to the receiver unit;

FIGS. 3*a*–3*c* illustrate signals occurring in different parts of the signal processing unit according to FIG. 2;

FIG. 4 schematically illustrates one embodiment in which the transmitter and receiver devices operate with densely emitted and received brief pulses;

FIG. 5 is a block diagram illustrating transmitter and receiver devices and the signal processing unit for the embodiment according to FIG. 4; and FIGS. 6*a*–6*g* shows signals occurring at different points in the signal processing unit according to FIG. 5.

DETAILED DESCRIPTION OF THE PREFERRED EMBODIMENT

Figure 4:
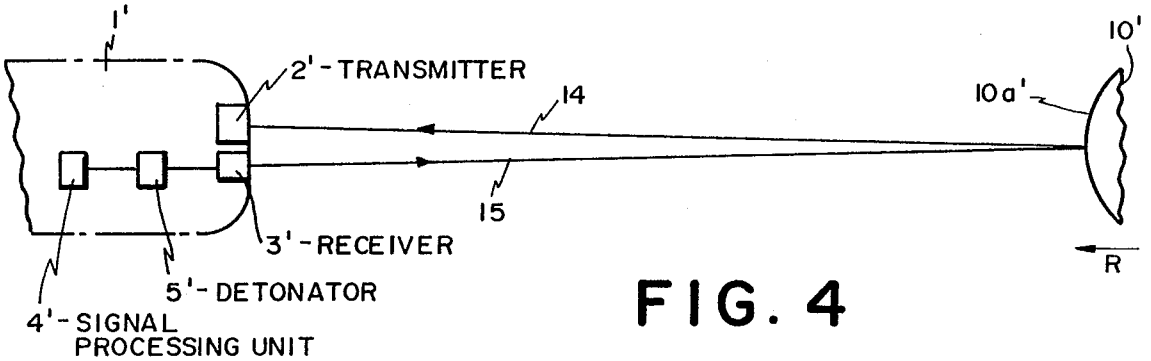

Referring to the drawings, FIG. 1 shows in part a carrier designated 1. The carrier is provided with a forwardly-scanning proximity fuse with transmitter devices 2 and receiver devices 3 for optical radiation. The transmitter and receiver devices may be of known type. Of the receiver device, the Figure shows a lens 3*a*, a diaphragm aperture 3*b* and a detector 3*c*. A signal processing unit connected to the receiver device is designated 4. A detonator or other initiating device connected to the unit 4 is designated 5. The detonator triggers a function or payload (not shown) in the carrier 1.

A departing optical strobe from the emitter device 2 is indicated by limit lines 6, 7. The limit lines of the receiver lobe are designated 8 and 9, and the first limit line 8 extends at an extremely acute angle to, or almost parallel with, the center line of the transmitter lobe. The second limit line 9 of the receiver lobe crosses the center line of the transmitter lobe at a distance L from the plane of intersection of the lens 3*c*. The distance between the plane and the outer line 8 of the receiver lobe is indicated by L'. Thus, the sensing region is defined by the inner and outer distances L, L'. The inner sensing limit is designated AG. The sensing region AV is sectioned in the figure. A target 10 reflects from its surface 10*a* the radiation emitted from the transmitter device to the receiver detector 3*c* when it is located within the sensing region. In the detector 3*c* a signal i is generated in response to the reflected, received radiation, the amplitude of the signal gaining the closer the target comes to the inner intersection limit 9. At a predetermined position within the region, this amplitude will exceed a preprogrammed threshold level Tn. On passage of the inner intersection limit, the signal amplitude will abruptly fall to a level down towards zero. This sudden fall in amplitude is employed, in accordance with the following disclosure, to trigger an activation signal i' from the signal processing unit. This activation signal influences the ignition device 5.

FIG. 1*a* shows, as a function of the distance, the above-described signal amplitude gain within the sensing region, and the rapid amplitude fade when the target passes the inner limit of the region at distance L. The threshold level is designated Tn.

Figure 3A:
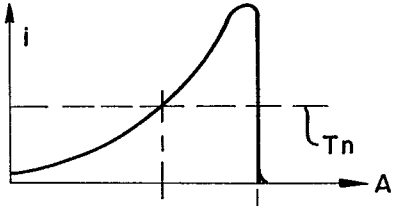
Figure 3B:
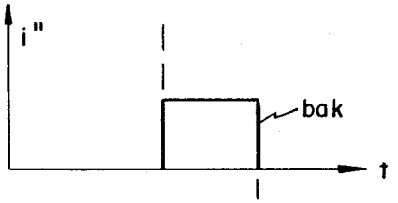
Figure 3C:
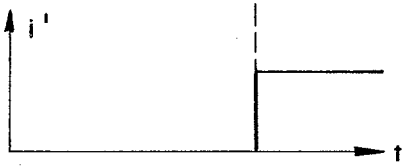

FIG. 2 indicates, with reference numerals corresponding to those of FIG. 1, the above-mentioned transmitter and receiver devices. The signal processing unit 4 is shown in greater detail. The unit includes an amplifier 11, a threshold circuit 12 and a flip-flop device 13. The parts 11, 12 and 13 may consist of previously known components. For example, the flip-flop device 13 may consist of a rear edge triggered master-slave flip-flop or a data flip-flop. FIGS. 3*a*, 3*b* and 3*c* illustrate the signals which occur in the points disclosed in FIG. 2 by corresponding reference numerals. FIG. 3*a* corresponds to FIG. 1*a* and shows the amplitude in the signal i during the relative movement of the target in the sensing region. FIG. 3*b* correspondingly shows the pulse i'' after the threshold device which is influenced by the signal i when this has reached a predetermined level Tn determined by the threshold circuit. FIG. 3*c* shows the pulse i' emitted from the flip-flop device. In addition to the above-mentioned threshold level, the length of the pulse i'' is determined by the passage of the target out of the sensing region when the signal i, in principle, disappears. The rear flank of the pulse is indicated by the designation bak. This rear flank influences or triggers the flip-flop device such that this switches and, on its output, emits the activation signal i'.

In FIG. 4, corresponding various units have been given the same designations as in FIG. 1, but these designations have been supplemented with a ' symbol. In this case, the transmitter device 2' emits brief densely occurring pulses according to FIG. 6*a*. By way of example, mention might be made that 10,000 pulses may be emitted per second and each respective pulse has a duration of the order of magnitude of nanoseconds. In FIG. 4, the optical radiation is indicated by reference numerals 14 and 15, respectively.

Figure 5:
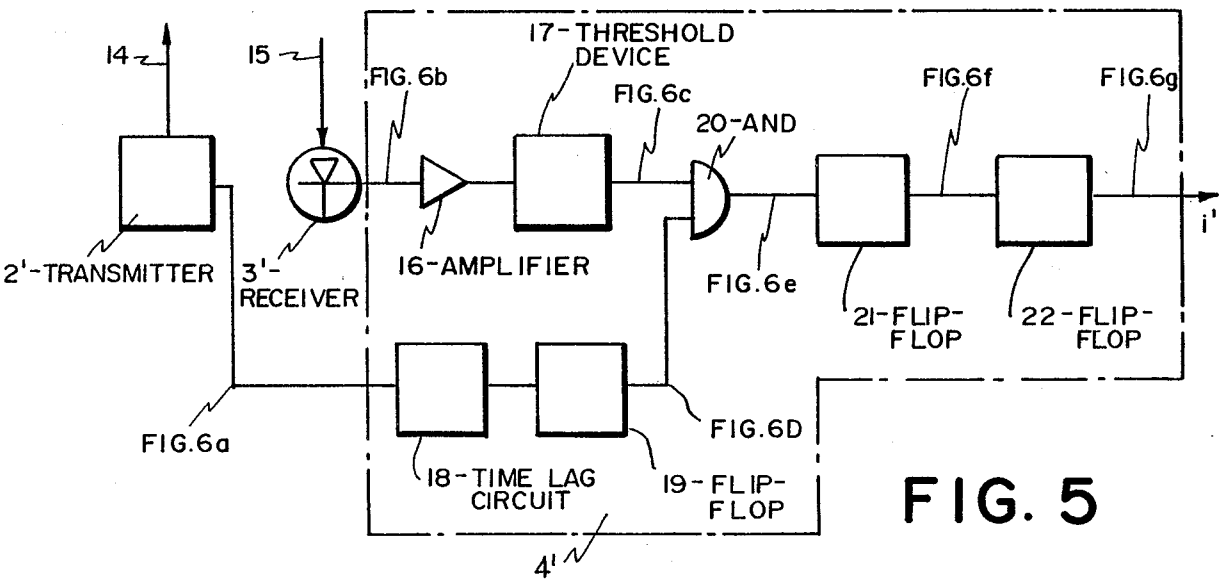
Figures 6A, 6B, 6C, 6D, 6E, 6F, 6G:
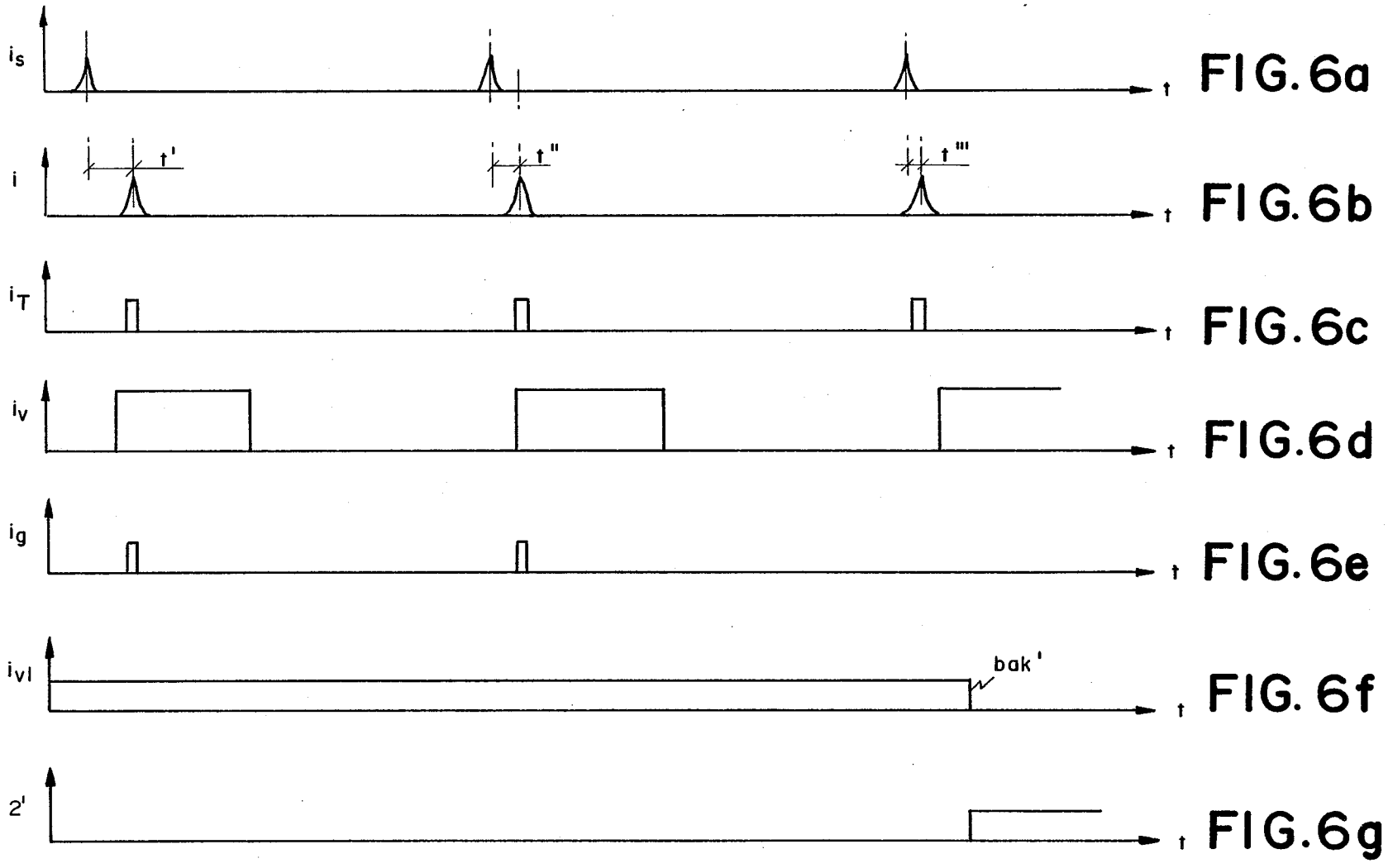

FIG. 6*b* shows received pulses reflected on the target surface 10*a*'. In FIG. 6*b*, the transit times between each respective emitted and received, reflected pulse is indicated by t', t'', t'''. These transit times are different and are intended to illustrate that the target, within the sensing region, is, approaching the carrier 1' within the sensing region. The inner and outer limits of the sensing region are determined by means of the signal unit 4' which is shown in greater detail in FIG. 5. The signals according to FIGS. 6*a*–6*g* occur in the points indicated with corresponding reference numerals according to FIG. 5. The signal processing unit determines the size of the sensing region by means of measurement of the transit times between emitted and reflected pulses.

The signal processing unit includes an amplifier 16 connected to the receiver device 3'. In this case, a threshold device 17 is also included. The unit 4' also operates with a reference circuit which is connected to the transmitter device and includes a time-lag circuit 18 and a monostable flip-flop 19. The outputs on the threshold device 17 and the monostable flip-flop 19 are connected to the inputs of an AND-gate 20. The output from this gate is connected to a resettable monostable flip-flop 21 which, in its turn, controls a rear edge triggered flip-flop 22. The monostable flip-flop 21 has a pulse length which exceeds the pulse interval of the emitted pulses from the transmitter device 2. The monostable flip-flop 19 is triggered by each respective emitted pulse by the intermediary of the time-lag device 18. As long as the monostable flip-flop is in the energized state, when the pulse according to FIG. 6 from the output of the threshold device 17 occurs, activation conditions prevail for the AND-gate 20. This entails that the resettable monostable flip-flop will remain energized, and that the rear-edge triggered flip-flop will not emit its output signal. This state exists for transit times of values indicated by t' and t''. Whebn the transit times are shorter, for example as short as t''', the pulse from the output of the threshold device 17 will occur before the monostable flip-flop 19 has had time to switch on. The activation conditions for the AND-gate cease and no signal will be obtained on the gate output in question. The resettable monostable flip-flop switches off and triggers or influences with its rear-edge bak' the rear-edge triggered flip-flop 22 which emits the signal i'. If the transit time between emitted and received pulse according to FIGS. 6a and 6b exceeds the switch-on time for the monostable flip-flop 19, neither will there be any activation conditions prevailing for the AND-gate 20, which entails that the resettable monostable flip-flop will, also in this case, switch off and, with its rear edge, trigger or influence the flip-flop 22. By means of the time-lag circuit 18 and the switch-on time for the monostable flip-flop, the inner and outer limits of the sensing region of the proximity fuse may thus be determined.

In FIGS. 6a–6g, the signal from the transmitter device is indicated by $i_S$, the signal from the threshold device is indicated by $i_T$, the signal from the flip-flop 19 is indicated by $i_V$, the signal from the gate 20 is indicated by $i_g$ and the signal from the flip-flop 21 is indicated by $i_{V1}$. Remaining signals are indicated as the above.

The present invention should not be considered as restricted to that described above and shown on the drawings, many modifications being conceivable without departing from the spirit and scope of the appended claims and inventive concept as herein disclosed.

What we claim and desire to secure by Letters Patent is:

1. In an active optic proximity fuse, an apparatus for providing increased resistance to precipitation, smoke, and clouds, comprising:

a transmitter device for emitting optical radiation;

a receiver device for receiving said optical radiation which has been reflected by a target located within a sensing region of the proximity fuse;

a signal processing unit connected to the output of said receiver device, said signal processing unit including:

(a) a threshold device for receiving said output signal from said receiver device and for generating an output signal when said received signal exceeds a predetermined threshold level of said threshold device; and (b) at least one rear edge triggered flip-flop device connected to the output of said threshold device for receiving an output signal from said threshold device and for emitting a triggering signal which is controlled by a rear edge of said output signal from said threshold device.

2. The apparatus as claimed in claim 1, wherein said flip-flop device controls the emission of said triggering signal when the target passes an inner sensing limit of said sensing region.

3. The apparatus as claimed in claim 2, wherein strobes of said transmitter and receiver devices intersect one another; and wherein inner and outer sensing distances may be determined by means of the intersection limits of the optical strobes.

4. The apparatus as claimed in claim 1, wherein optical strobes of said transmitter and receiver devices intersect one another; and wherein inner and outer sensing distances are determined by means of the intersection limits of the optical strobes.

* * * * *